US006851399B2

(12) United States Patent
Herynek et al.

(10) Patent No.: US 6,851,399 B2
(45) Date of Patent: Feb. 8, 2005

(54) METHOD FOR MONITORING A COOLANT CIRCUIT OF AN INTERNAL COMBUSTION ENGINE

(75) Inventors: Roland Herynek, Oetisheim (DE); Martin Vollmer, Stuttgart-Weilimdorf (DE)

(73) Assignee: Robert Bosch GmbH, Stuttgart (DE)

( * ) Notice: Subject to any disclaimer, the term of this patent is extended or adjusted under 35 U.S.C. 154(b) by 0 days.

(21) Appl. No.: 10/333,547

(22) PCT Filed: Apr. 17, 2002

(86) PCT No.: PCT/DE02/01417

§ 371 (c)(1),
(2), (4) Date: Jan. 22, 2003

(87) PCT Pub. No.: WO02/101210

PCT Pub. Date: Dec. 19, 2002

(65) Prior Publication Data

US 2004/0011305 A1 Jan. 22, 2004

(51) Int. Cl.[7] ..... F01P 5/10
(52) U.S. Cl. ..... 123/41.44; 73/116
(58) Field of Search ..... 123/41.44, 198 D; 73/116

(56) References Cited

U.S. PATENT DOCUMENTS 4,062,231 A * 12/1977 Mercik et al. ..... 73/116
5,201,285 A 4/1993 McTaggert
6,477,989 B2 * 11/2002 Suzuki et al. ..... 123/41.1

FOREIGN PATENT DOCUMENTS

| | | |
|---|---|---|
| DE | 41 09 498 A1 | 9/1992 |
| EP | 0 578 564 | 1/1994 |
| FR | 2 793 842 A | 11/2000 |

* cited by examiner

*Primary Examiner*—Noah P. Kamen
(74) *Attorney, Agent, or Firm*—Michael J. Striker

(57) ABSTRACT

This invention is based on a method for monitoring a cooling fluid circuit (16) of an internal combustion engine (10), with at least one heat exchanger (18, 22), a regulating valve (26), a cooling fluid pump (32), and an electronic control unit (76). The invention proposes that the control unit (76) predetermine a permissible upper and lower deviation of a reference parameter from a desired value, based on operating parameters of the internal combustion engine (10) and with the aid of deviation characteristic fields (56, 58), and that it compare these permissible upper and lower deviations to a difference between a desired value and an actual value of the reference parameter, wherein the actual value is determined based on parameters of the volumetric flow of the cooling fluid, possibly with the aid of characteristic fields (42, 46, 74).

12 Claims, 2 Drawing Sheets

METHOD FOR MONITORING A COOLANT CIRCUIT OF AN INTERNAL COMBUSTION ENGINE

BACKGROUND OF THE INVENTION

The invention is based on a method for monitoring a cooling fluid circuit in an internal combustion engine.

In modern reciprocating piston internal combustion engines for motor vehicles, the heat transmitted to a cylinder head and cylinder block through a wall of a combustion chamber is essentially dissipated by means of a cooling fluid. The cooling fluid is circulated by means of a pump, which is as a rule mechanically driven by the internal combustion engine. There are also known embodiments in which a controllable electric motor is used as a pump drive unit. A regulating valve conveys the cooling fluid through a radiator or through a bypass line, which is provided parallel to the radiator. In addition to the radiator, a heating system heat exchanger for the passenger compartment is also connected to the cooling fluid circuit. A desired temperature of the cooling fluid, possibly controlled by means of a characteristic field, is set so that the permissible temperatures of the cooling fluid and of the components to be cooled are never exceeded during operation.

DE 41 09 498 A1 has disclosed a device and a method for a very sensitive regulation of the temperature of an internal combustion engine. To this end, a control device is supplied with a number of input signals, e.g. the temperature of the engine, the speed and load of the engine, the vehicle speed, the operating state of an air conditioning or heating system of the motor vehicle, and the temperature of the cooling water. A desired value transmitter of the control unit takes the input signals into account when establishing a desired value for the temperature of the engine. According to a comparison of the actual values to the desired values, the control unit controls a three-way valve, which is disposed in the mouth region of a bypass line in a line between the engine and a radiator. Depending on the position of the three-way valve, the inlet flow is distributed to the radiator inlet and to the bypass line. Therefore a cooling of the engine is detected not only as a function of operating parameters that are of direct significance to the temperature build-up, but also as a function of parameters of additional units, which only influence the temperature indirectly. Furthermore, the possibilities for setting the optimal temperature are broadened significantly since malfunctions can also be detected and taken into account. The association of different operating conditions with different ranges of desired temperature values permits the desired temperature to be quickly adjusted, which can be further refined through different priorities of the operating conditions.

For the emissions behavior of an internal combustion engine, it is of crucial importance that the engine reach its optimal operating temperature as rapidly as possible and maintain this temperature for the duration of its operation. This essentially depends on the temperatures of the heat-conducting components that constitute the combustion chamber, in particular the walls of the cylinders, the cylinder block, and the cylinder head. The temperatures in turn depend on operating parameters such as the speed and load of the engine, the volumetric flow and temperature of the cooling fluid, and the load changes, etc. The interrelationships among these parameters and the temperature of the components are extremely complex and cannot be calculated analytically. In order to assure a uniformly good emissions behavior of the internal combustion engine over its entire service life, it is therefore necessary to monitor the proper function of the cooling fluid circuit.

SUMMARY OF THE INVENTION

According to the invention, the control unit predetermines a permissible upper and lower deviation of a reference parameter from a desired value based on operating parameters of the internal combustion engine and with the aid of deviation characteristic fields. The control unit compares these deviations with a difference between a desired value and an actual value of the reference parameter, and the actual value is determined from parameters of the volumetric flow of cooling fluid, possibly with the aid of characteristic fields.

The invention is based on the knowledge that the emissions of an internal combustion engine are influenced by the combustion and this combustion in turn is influenced by the temperatures of critical components, in particular of the combustion chamber wall, which in reciprocating piston internal combustion engines is chiefly comprised of the inner wall of the cylinders and the cylinder head. If the relationshiop between the component temperature and the emissions as a function of an operating point of the engine is known and lies within a characteristic field, then the diagnosis and monitoring are executed by monitoring the component temperatures. In this case, the temperature of the component itself or of a parameter associated with this temperature can be used as a reference parameter. The temperatures of the selected reference component in a given internal combustion engine at a particular operating point are determined by means of the temperature and the volumetric flow of the cooling fluid. According to the invention, therefore, the temperature and the volumetric flow of the cooling fluid are used to monitor the cooling fluid circuit.

In one embodiment of the invention, in which the temperature of the reference component itself—e.g. of the wall of a cylinder, cylinder block, or cylinder head—is used as a reference parameter, an actual value of the temperature of the reference component is determined with the aid of a temperature characteristic field, a cooling fluid temperature preferably measured at the outlet of the internal combustion engine, and an actual value of the volumetric flow. In this case, the actual value of the volumetric flow is inferred from a differential pressure at the throttle restriction in the main flow of the cooling fluid and from the trigger signal of the cooling fluid pump. The difference is calculated between the actual value and a desired value of the temperature of the reference component, which is determined from the speed and load of the internal combustion engine with the aid of an additional temperature characteristic field, and this difference is compared to a permissible lower and upper deviation of the temperature of the reference component. If the result of the comparison is greater than or equal to one, then an output signal is generated that indicates a malfunction in the cooling fluid pump or in the cooling fluid circuit, for example due to the fluid pump or a regulating valve being jammed, or due to a hose being crushed.

When heated, the cooling fluid temperature is either kept constant or varies within a permissible range. The cooling fluid temperature signal can be diagnosed by using a broadened characteristic field or through the provision of more extensive data in the control unit. For cold starting, an additional characteristic field is suitably stored in the control unit, which theoretically simulates the temperature increase of the reference component. This can be used to detect whether the cooling fluid temperature is increasing to the predetermined extent. This assures that during continuous operation, the internal combustion engine does not continue to be operated cold and in a poor emissions range, for example if a regulating valve jams and the cooling fluid is conveyed through the radiator even though the engine is still cold.

Since the volumetric flow of the cooling fluid essentially depends on the differential pressure between the pressure side and the suction side of a throttle restriction in the main flow of the cooling fluid, it is easily possible according to one embodiment of the invention, to select the differential pressure as the reference parameter. In this case, a desired value for a differential pressure is determined from a triggering signal of the cooling fluid pump with the aid of a differential pressure characteristic field. The throttle restriction can be constituted by the cooling fluid pump itself or can be disposed at another point in the main flow of the cooling fluid. Based on the desired value and the actual value of the differential pressure, which is measured by means of a differential pressure sensor at a throttle restriction in the main flow of the cooling fluid, a difference is calculated, which is compared to an upper and lower permissible deviation. The throttle restriction can be constituted by the cooling fluid pump itself or can be disposed at another point in the main flow of the cooling fluid. The permissible deviations are inferred from corresponding characteristic fields as a function of the speed and load of the internal combustion engine.

Another embodiment of the invention provides another simplified method, which is particularly suited for cooling fluid circuits with a mechanically driven cooling fluid pump and whose cooling fluid circuit is provided with a throttle valve for regulating the volumetric flow. In this case, a desired value for a differential pressure is predetermined based on the position of the throttle valve and a triggering signal of the cooling fluid pump, with the aid of a differential pressure characteristic field. In addition, an actual value for a differential pressure is determined based on the temperature of the cooling fluid at the outlet of the internal combustion engine and an absolute pressure of the cooling fluid downstream of the cooling fluid pump, with the aid of an additional differential pressure characteristic field. The difference between the desired value and the actual value of the differential pressure is compared as described above to a corresponding lower and upper permissible deviation of the differential pressure. The permissible deviations are obtained from the speed and load of the internal combustion engine, with the aid of corresponding characteristic fields.

BRIEF DESCRIPTION OF THE DRAWINGS

Other advantages ensue from the following description of the drawings. Exemplary embodiments of the invention are depicted in the drawings. The drawings, the specification, and the claims contain numerous features in combination. One skilled in the art will suitably also consider the features individually and will unite them in other meaningful combinations.

BRIEF DESCRIPTION OF THE DRAWINGS

Figure 1:
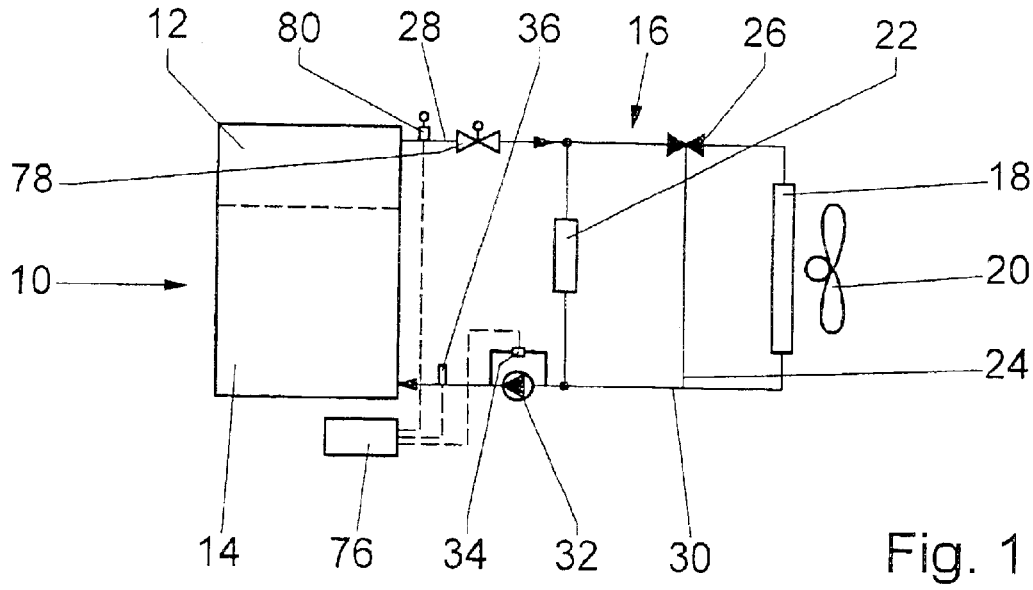
Figure 2:
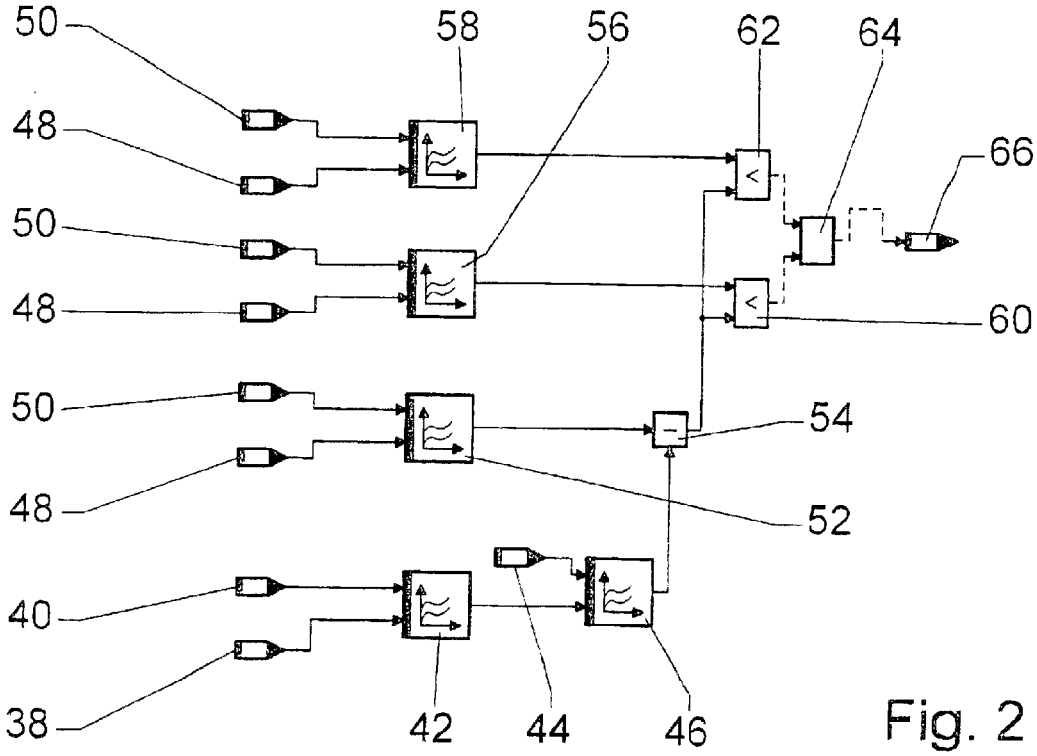
Figure 3:
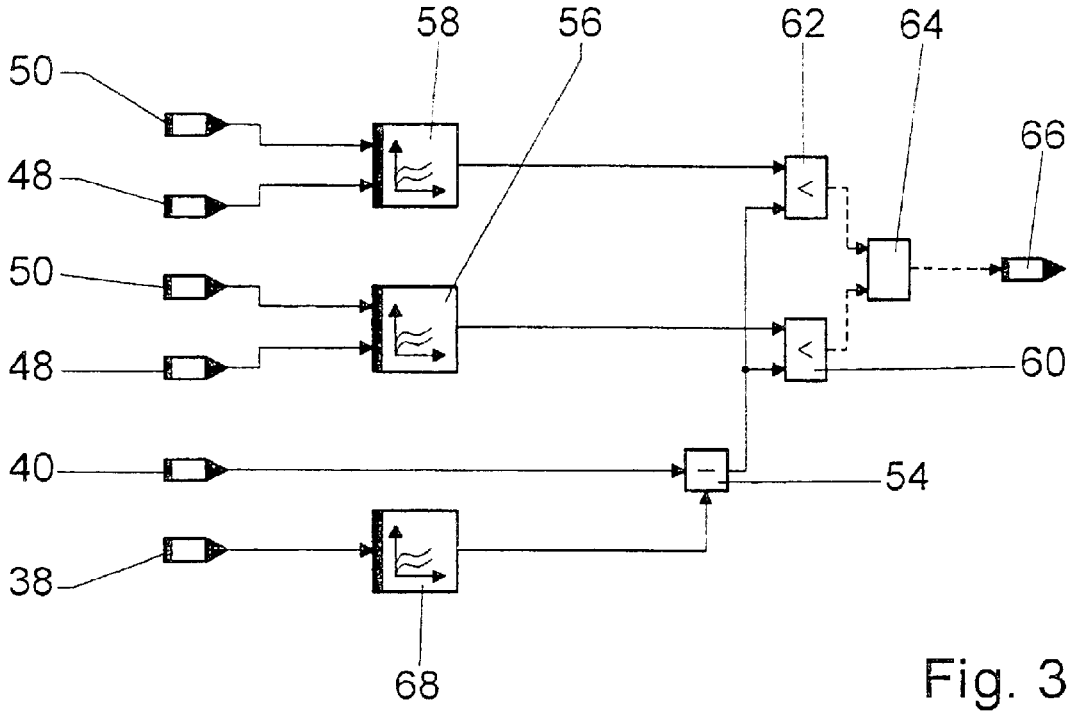
Figure 4:
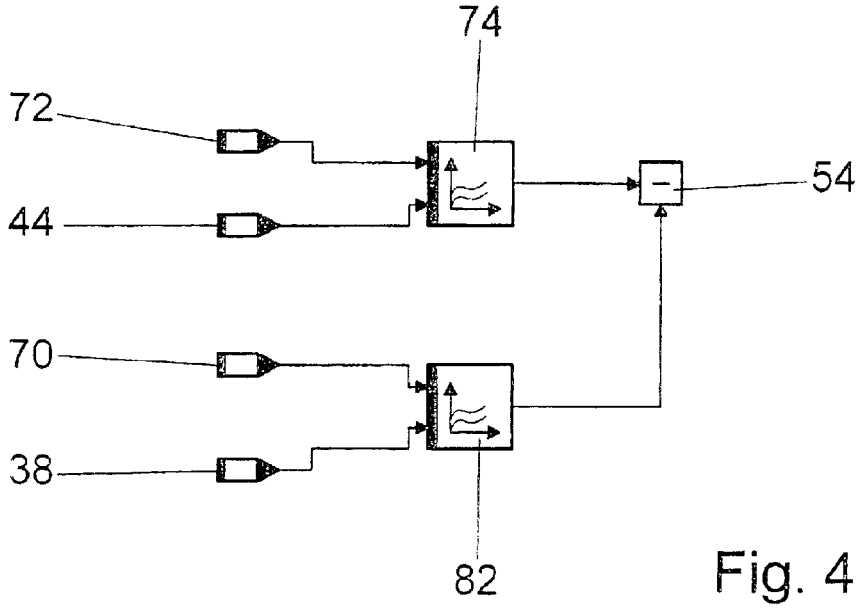

FIG. 1 shows a schematic design of a cooling fluid circuit for an internal combustion engine, FIG. 2 depicts an evaluation logic circuit for a cooling fluid circuit with a differential pressure sensor, FIG. 3 shows a variant of FIG. 2, and FIG. 4 depicts an evaluation logic circuit for a cooling fluid circuit with an absolute pressure sensor.

DESCRIPTION OF THE PREFERRED EMBODIMENTS

An internal combustion engine 10 includes a cylinder head 12 and a cylinder block 14, which are connected to a cooling fluid circuit 16. The flow direction of the cooling fluid in the cooling fluid circuit 16 is indicated with arrows. A cooling fluid pump 32 feeds the cooling fluid from an intake line 30, through the cylinder block 14 and the cylinder head 12, and into a return line 28. A radiator 18 that cooperates with a fan 20 is connected between this return line 28 and the intake line 30. A bypass line 24 and a heating system heat exchanger 22 are provided parallel to the radiator 18 and a regulating valve 26 controls the flow through the radiator 18 and the bypass line 24.

Parallel to the cooling fluid pump 32, a differential pressure sensor 34 is provided, which detects the differential pressure between the suction side and the pressure side of the cooling fluid pump 32. Alternatively or in addition to the differential pressure sensor 34, a pressure sensor 36 is provided on the pressure side of the cooling fluid pump 32, which pump can be electrically or mechanically driven. This pressure sensor 36 detects the absolute pressure of the cooling fluid in relation to the ambient pressure. In addition, a temperature sensor 80 and a throttle valve 78 are disposed at the outlet of the cylinder head 12 of the internal combustion engine 10. The differential pressure sensor 34, the pressure sensor 36, and the temperature sensor 80 are connected via signal lines to a control unit 76, which among other things, performs the monitoring of the cooling circuit 16.

To this end, in connection with an evaluation logic circuit according to FIG. 2, a volumetric flow characteristic field 42, temperature characteristic fields 46 and 52, and deviation characteristic fields 56 and 58 are stored in the control unit 76. In addition to a triggering signal 38 of the cooling fluid pump 32, a differential pressure signal 40 of the differential pressure sensor 34, and a cooling fluid temperature signal 44 of the temperature sensor 80, the control unit 76 also receives a speed signal 48 and a load signal 50 of the internal combustion engine 10. Based on the triggering signal 38 of the cooling fluid pump 32 and the differential pressure signal 40, and with the aid of the volumetric flow characteristic field 42, the control unit 76 determines an actual value of the volumetric flow, based on which it calculates an actual value for the temperature of the reference component 12, 14 with the aid the cooling fluid temperature signal 44 and a temperature characteristic field 46 for a reference component, e.g. the cylinder block 14 or the cylinder head 12. It also determines a desired value for the temperature of the reference component 12, 14, based on the speed signal 48 and the load signal 50 of the internal combustion engine 10 in connection with an additional temperature characteristic field 52 for the reference component 12, 14, and calculates the difference between the desired value and the actual value in a comparison component 54. Finally, the control unit 76 determines a permissible upper deviation based on the speed signal 48 and the load signal 50, with the aid of a deviation characteristic field 56. An additional deviation characteristic field 58 is correspondingly used to determine a permissible lower deviation. In subtractors 60 and 62, the permissible deviations are compared to the difference from the comparison component 54. If the result is greater than or equal to one, then a signal output 64 generates an output signal 66 that indicates a malfunction in the cooling fluid circuit 16.

In the evaluation logic circuit according to FIG. 3, the differential pressure at a throttle restriction or resistance, e.g.

the cooling fluid pump 32, is used as a reference parameter on which the volumetric flow of the cooling fluid essentially depends. Based on the triggering signal 38 of the cooling fluid pump 32, a differential pressure characteristic field 68 is used to determine a desired value for the differential pressure, and the comparison component 54 calculates the difference from the actual value of the differential pressure according to the differential pressure signal 40. The difference thus calculated is compared to permissible deviations in the subtractors 60 and 62, wherein the signal output 54 also generates an output signal if the result is greater than or equal to one. Deviations are determined in the same manner as in the evaluation logic circuit according to FIG. 2.

The evaluation logic circuit according to FIG. 4 differs from the evaluation logic circuit according to FIG. 3 in that the volumetric flow is regulated by means of a throttle valve 78. In this case, the desired value of the differential pressure is determined based on the triggering signal 38 of the cooling fluid pump 32 and a valve position signal 70 of the throttle valve 78, with the aid of a differential pressure characteristic field 82. The actual value of the differential pressure is calculated from the cooling fluid temperature signal 44 and a pressure signal 72 for the pressure of the cooling fluid in relation to the ambient pressure, with the aid of a differential pressure characteristic field 74. The comparison component 54 calculates the difference between the desired value and the actual value of the differential pressure. Finally, the difference is compared to permissible lower and upper deviations, as in the evaluation logic circuit according to FIG. 3, and a corresponding output signal is generated if the result is greater than or equal to one.

What is claimed is:

1. A method of monitoring a cooling fluid circuit (16) of an internal combustion engine, including at least one heat exchanger (18, 22), a regulating valve (26), a cooling fluid pump (32), and an electronic control unit (76), the method comprising the steps of predetermining by the control unit (76) a permissible upper and lower deviation of a reference parameter from a desired value based on operating parameters of the internal combustion engine (10) and with use of deviation characteristic fields (56, 58); comparing the permissible upper and lower deviations to a difference between a desired value and an actual value of the reference parameter; and determining the actual value based on parameters of a volumetric flow of a cooling fluid.

2. A method as defined in claim 1, wherein said determining the actual value includes determining the actual value based on parameters on the volumetric flow of the cooling fluid with use of further characteristic fields (42, 46, 74).

3. A method as defined in claim 2; and further comprising selecting the reference parameter of a reference component (12, 14); providing the determining of an actual volume of volumetric flow of the cooling fluid based on a differential pressure between a pressure side and a suction side of a throttle restriction (32) in a main flow of the cooling fluid and based on a trigger signal (38) of the cooling fluid pump (32) with use of one of the further characteristic fields (42); determining an actual value of the temperature of the reference component (12, 14) based on the actual value of the volumetric flow and the cooling fluid temperature with use of another (46) of the further characteristic fields of the reference component (12, 14), which is a temperature characteristic field; determining a desired value of the temperature of the reference component (12, 14) based on a speed and load of the internal combustion engine (10) with use of an additional temperature characteristic field (52); calculating a difference between the actual value and the desired value of the temperature of the reference component (12, 14); and determining a permissible lower deviation of the temperature of the reference component (12, 14) based on the speed and load of the internal combustion engine (10) with use of one of the first mentioned characteristic fields (56) and a permissible upper deviation of the temperature of the reference component (12, 14) with use of another one of the first mentioned deviation characteristic fields (58); comparing the difference between the actual value and the desired value of the temperature of the reference component (12, 14) to the lower permissible and upper permissible deviations of the temperature of the reference component; and generating an output signal if a result of the comparison is greater than or equal to one.

4. A method as defined in claim 3; and further comprising selecting the reference component as a wall of an element selected from the group consisting of a cylinder block and a cylinder head of the internal combustion engine (10) which is a reciprocating piston internal combustion engine.

5. A method as defined in claim 3; and further comprising detecting the cooling fluid temperature at an outlet of the internal combustion engine (10).

6. A method as defined in claim 1; and further comprising selecting as the reference parameter a differential pressure between a pressure side and a suction side of a throttle restriction (32, 78) in a main flow of the cooling fluid; determining a desired value for the differential pressure between the pressure side and the suction side of the throttle restriction (32, 78) based on a triggering signal (38) of the cooling fluid pump (32) with use of an additional differential characteristic field (68); calculating a difference between the desired value and a measured actual value of the differential pressure between the pressure side and the suction side of the throttle restriction (32, 78); determining a permissible lower deviation of the differential pressure based on a speed and load of the internal combustion engine (10) with use of one of the deviation characteristic fields (56) and a permissible upper deviation of the differential pressure with use of another of the deviation characteristic fields (58); comparing the difference between the desired value and the actual value of the differential pressure to the lower permissible and upper permissible deviations of the differential pressure; and generating an output signal if a result of the comparison is greater than or equal to one.

7. A method as defined in claim 6; and further comprising using the cooling fluid pump (32) as the throttle restriction.

8. A method as defined in claim 1; and further comprising selecting the reference parameter as a differential pressure between a pressure side and a suction side of a throttle restriction (32, 78) in a main flow of the cooling fluid; determining a desired value for a differential pressure based on a trigger signal (38) of the cooling fluid pump (32) and a position of a throttle valve (78) with use of a further differential pressure characteristic field (82); determining an actual value for the differential pressure based on a temperature of the cooling fluid at an outlet of the internal combustion engine (10) and an absolute pressure of the cooling fluid downstream of the cooling fluid pump (32) with use of one of the additional characteristic fields (74); determining a permissible lower deviation of the differential pressure based on a speed and load of the internal combustion engine (10) with use of one of the first mentioned deviation characteristic fields (56), and a permissible upper deviation of the differential pressure with use of another of the first mentioned deviation characteristic fields (58); comparing a difference between the desired value and the actual value of the differential pressure to the lower permissible and upper permissible deviations of the differential pressure; and generating an output signal (66) if a result of the comparison is greater than or equal to one.

9. A method as defined in claim 1; and further comprising storing a proper temperature increase of the cooling fluid during a starting phase of the internal combustion engine (10) in a characteristic field in the control unit (76); and comparing it to an actual value of a temperature increase, which is determined by deriving the cooling fluid temperature over time.

10. An internal combustion engine (10), comprising a cooling fluid circuit (16), at least one heat exchanger (18, 22), a regulating valve (26), a cooling fluid pump (32), and an electronic control unit (76), said electronic control unit (76) being formed so as to perform a method including the steps of predetermining by the control unit (76) a permissible upper and lower deviation of a reference parameter from a desired value based on operating parameters of the internal combustion engine (10) and with use of deviation characteristic fields (56, 58); comparing the permissible upper and lower deviations to a difference between a desired value and an actual value of the reference parameter; determining the actual value based on parameters of a volumetric flow of the cooling fluid; and a differential pressure sensor connected in parallel with said cooling fluid pump (32).

11. An internal combustion engine as defined in claim 10; and further comprising a pressure sensor (36) for detecting an absolute pressure of the cooling fluid in relation to an ambient pressure and disposed downstream of the cooling fluid pump (32).

12. An internal combustion engine as defined in claim 10; and further comprising a temperature sensor (80) provided at an outlet of the cooling fluid from the internal combustion engine (10).

* * * * *